US006293017B1

(12) United States Patent
Sato et al.

(10) Patent No.: US 6,293,017 B1
(45) Date of Patent: Sep. 25, 2001

(54) RECIPROCATING TYPE ELECTRIC SHAVER

(75) Inventors: Masaaki Sato; Takeshi Shiba, both of Hikone; Hikoyoshi Nakagawa, Takatsuki, all of (JP)

(73) Assignee: Matsushita Electric Works, Ltd. (JP)

( * ) Notice: Subject to any disclaimer, the term of this patent is extended or adjusted under 35 U.S.C. 154(b) by 0 days.

(21) Appl. No.: 09/277,456

(22) Filed: Mar. 26, 1999

(30) Foreign Application Priority Data

Mar. 26, 1999 (JP) ..... 10-078654

(51) Int. Cl.[7] ..... B26B 19/06
(52) U.S. Cl. ..... 30/43.92; 30/346.51
(58) Field of Search ..... 30/43.92, 346.51

(56) References Cited

U.S. PATENT DOCUMENTS 5,398,412 * 3/1995 Tanahashi et al. ..... 30/43.92

* cited by examiner

*Primary Examiner*—Douglas D. Watts
(74) *Attorney, Agent, or Firm*—Pennie, Edmonds LLP

(57) ABSTRACT

The invention relates to a reciprocating type electric shaver comprising blade heads including a slit blade, a slit inner blade, web blades, a web outer blade, a slit outer blade, a web inner blade for cutting the beard introduced from perforations of said web outer blade with said web outer blade, said web inner blade being slidable connected to the inner surface of said web outer blade and reciprocating, wherein said slit outer blade has on the planar upper surface having slits therein, a flat portion substantially parallel to the axis where the peaks of the adjacent web blades are aligned in a line, said slit inner blade being slidable inside the flat portion, said slit outer blade having a blade edge projecting outward at the web blade side beyond the side walls of said slit outer blade, with said blade edge located at side edges along the reciprocating direction of said slit inner blade on the flat portion, and the blade edge is formed on the upper surface with a tapered face successive to the flat portion so as to be slant in the direction lower than the flat portion as approaching the outside end of the blade edge.

11 Claims, 15 Drawing Sheets

RECIPROCATING TYPE ELECTRIC SHAVER

BACKGROUND OF THE INVENTION

1. Field of the Invention

The present invention generally relates to a reciprocating electric shaver.

2. Description of the Related Art

Recently, for the purposes of higher shaving speed using multiple heads as well as finishing ability for shortly shaved beard, a combination of a roughly shaving blade and a finishing blade has been proposed. Such examples include a shaver having a slit-like blade placed at the centre and web-like blades at the outer sides.

In this regard, the slit blade introduces long or kinked beard and cuts such beard to be short. Thereafter, the web blades finish the shorted beard to become shorter.

However, slit blades generally have a high ability of introducing the beard, but the beard lying around the chin or the like impinges on bars formed between slits of a slit outer blade, then passes thereover. Therefore, there arises a problem in which such beard cannot be introduced into the slits. Furthermore, blade edges arranged at the side edges on the upper surface of the slit outer blade each must have more reduced curvature radius to more effectively introduce such lying beard. However, sharpened blade edge will largely stimulate to the skin, to thereby give an uncomfortable feeling to the skin.

Heretofore, for example, Japanese Utility Model Publication No. Sho 40-16113 specification describes a proposed example having a structure in which a pair of slit blades are juxtaposed adjacent each other at the same level, the slit blades each having the upper surface thereof slant in a V shape with each blade edge down. Further, Japanese Utility Model Publication No. Sho 49-595 specification described another proposed example in which a slit blade having a structure wherein blade edges project beyond the outer edges on the upper surface of a slit outer blade has slant faces in the direction where the blade edges are down toward the outer edges of the blade edges from the vicinity of the blade edges on the upper surface thereof. Still further, U.S. Pat. No. 2,325,606 publication describes still another proposed example having a structure in which a slit outer blade is formed with a gently curved convexity over the upper surface, and each slit inner blade is slidable at the inside the upper surface of the slit outer blade and a blade edge portion.

However, with the structure proposed in Japanese Utility Model Publication No. 40-16113 specification, in which adjacent slit blades are juxtaposed at the same level the slit blades each having the upper surface thereof slant in a V shape with each blade edge down, the slit blades each having no horizontal upper surface when each slit blade is arranged between web blades are caused to be unstably contacted with the skin. In addition, the slit blades each is formed with a groove at the centre on the upper surface thereof, and the groove is formed with a projection on the side surface which is forcibly contacted with the skin. This gives an uncomfortable contact with the skin. Furthermore, the blade edge portion having each inner blade slidable does not substantially contact with the skin, while each inner blade is not slidable on the upper surface in the vicinity of the groove at the centre where the skin is contacted. In this connection, the effects of guiding and cutting the beard are low, so that the slit blades may not sufficiently function.

With such a structure proposed in Japanese Utility Model Publication No. Sho 49-595 specification as described above, in which a slit blade is formed on the upper surface thereof with slant faces in the direction where the blade edges are down, the slit blades having no horizontal upper surfaces when each slit blade is arranged between web blades are caused to be unstably contacted with the skin. Then, each blade edge portion is forcibly contacted with the skin, giving an uncomfortable contact with the skin. Further, since each inner blade is slidable only on the slant faces, there occurs such a problem that the beard cannot be shortly shaved.

With such a structure proposed in U.S. Pat. No. 2,325,606, publication, in which a slit inner blade is slidable at the inside between the upper surface of the slit outer blade and the blade edge portion, the thickness in the vicinity of the blade edge on the upper surface of the slit outer blade is thinned, and the inner blade can be also slidable at the blade edge portion. Therefore, there is a problem in which the skin may be damaged by cutting.

In view of the foregoing conventional examples, the present invention has been made and an object of the present invention is to provide a reciprocating type electric shaver capable of guiding the beard and having reduced stimulation to the skin.

SUMMARY OF THE INVENTION

In order to overcome the foregoing problems, according to the present invention, With such an arrangement, a flat portion 15 formed on the upper surface of the slit outer blade 2 is stably contacted with the skin. The guiding function is effectively performed at each blade edge 5. Furthermore, the tapered face 16 allows the skin between the adjacent web blades 11 to be contacted with the flat portion 15 of the slit outer blade 2 under a stable condition. The tapered face 16 further prevents each blade edge 5 from contacting with the skin, and allows the skin to closely contact therewith so that it ensures that the beard can be introduced. Therefore, the ability of guiding the beard can be enhanced without an uncomfortable contact with the skin. Furthermore, since the slit inner blades 3 are slidable only inside the flat portion 15, the tapered face 16 contacting with the skin would not be stimulated to the skin.

Preferably, the width dimension L of each bar formed between the slits of the slit outer blade 2 is reduced as approaching each blade edge 5. In this case, the tapered face 16 prevents each blade edge 5 reduced in width from being sunk into the skin, realizing a high degree of the opening formed at each blade edge 5 without an uncomfortable contact with the skin.

Preferably, the slit outer blade 2 has is at the centre on the upper surface thereof a recess portion 81 recessed at a lower level than the flat portion 15. This enables the lying beard to be raised within the recess portions 81. Thus, opportunity of guiding the beard can be doubled.

Preferably, a cooperating portion is provided for moving the slit blade 1 cooperated with the downward motion of web blades 11 when the web blades 11 are down. In this case, the cooperation of the web blades 11 and the slit blade 1 prevents the relative distance formed between the peaks of the web blades 11 and the upper surface of the slit blade 1 from being increased. With such an arrangement, the blade edge 5 of the slit blade 1 is not so exposed beyond the peaks of the web blades 11. This prevents the skin from being damaged and the skin from being pinched between the web blades 11 and the blade edge 5 of the slit blade 1.

Preferably, this enables the blade edge 5 of the slit blade 1 to effectively introduce the beard without giving an uncomfortable feeling to the skin.

Preferably, a cooperating portion between the slit blade 1 and the web blades 11 are provided at the position inner than the side walls 4 of the slit outer blade 2. This enables, for example, the cooperating position of the web blades 11 and the slit blade 1 to be at substantially the same level in the direction of the thickness of the slit blade 1.

Therefore, the slit blade 1 can be more smoothly floated during the cooperation.

Preferably, the cooperating portion of the slit blade 1 and the web blades 11 is arranged at the ends in the direction where the slit inner blade 3 is slidable. Therefore, the relative step difference between the web blades 11 and the slit blade 1 is made constant at any place in the slidable direction thereof, and the blade edge 5 of the slit blade 1 is prevented from being exposed.

Preferably, the blade edge 5 of the slit outer blade 2 is projected outward C in a substantially triangular manner from each side wall 4 of the slit outer blade, the projecting peak 5*a* of the blade edge 5 projecting in a substantially triangular manner being formed on a convexity 6, a recess portion 7 recessed substantially opposite to the projecting direction of the blade edge 5 being formed in the vicinity of the blade edge 5, the recess portion 7 being downward faced at any place within the recess portion with the normal Z downwardly faced to the horizontal line. In this regard, the beard impinging upon the blade edge 5 is captured into the recess portion 7 which is downwardly faced at any place.

Therefore, the beard captured into the recess portion 7 can ensure to be raised, trimmed and introduced, so that the beard can be effectively shaved. In addition, projecting peak 5*a* of the blade edge 5 is formed with a convexity 6, and this can reduce the stimulation to the skin.

Preferably, the recess portion 8 is plural. This arrangement can increase a chance of picking up the beard and improve the guiding ability.

Further, preferably, the recess portion 8 is arranged only on each side edge 5*b* of each bar of the blade edge 5.

This arrangement can more ensure the strength of the blade edge 5.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE PREFERRED EMBODIMENTS

An embodiment in accordance with of the present invention will now be described.

Figure 2:
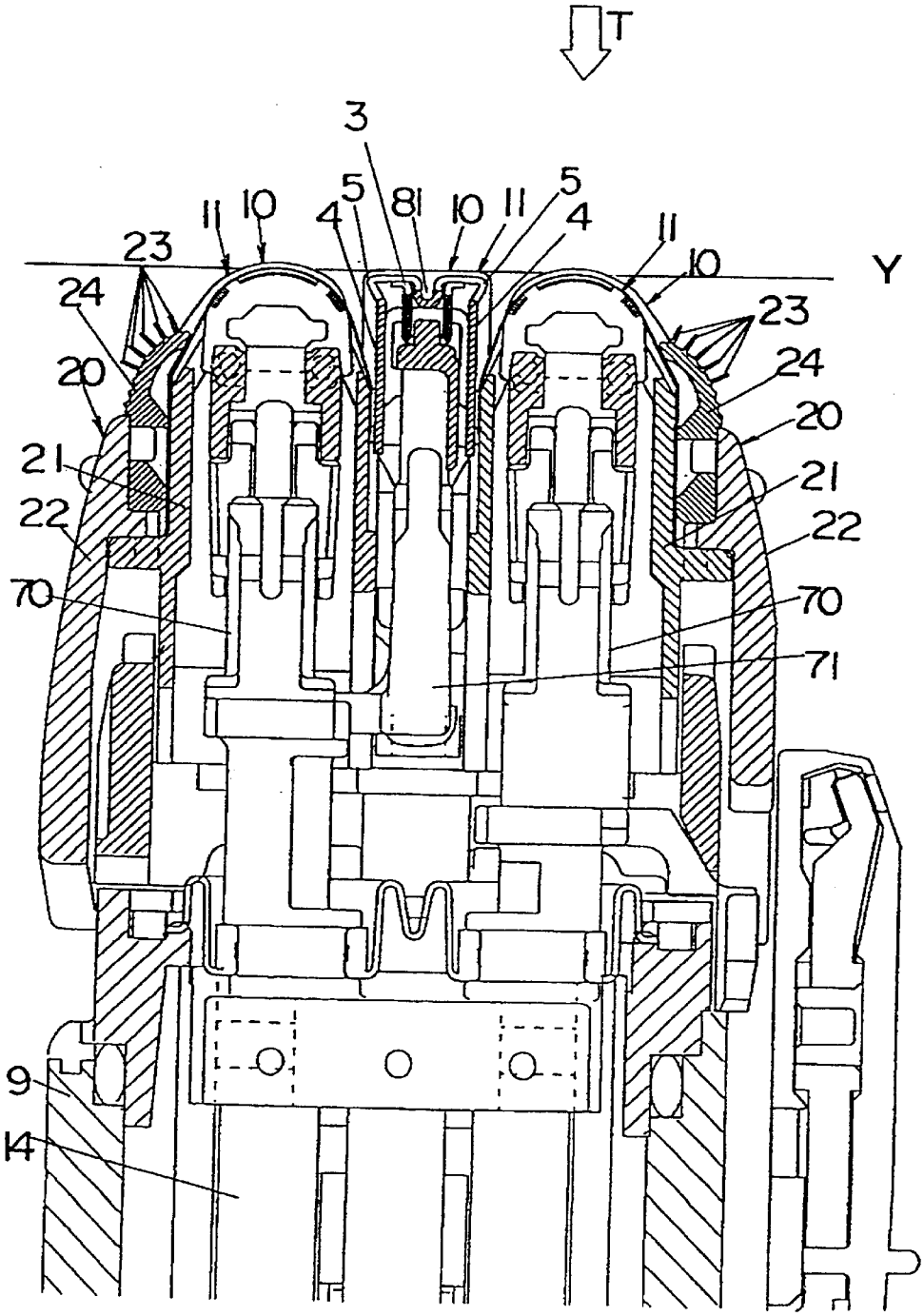
FIG. 2 is a cross-sectional view showing a blade head side of a reciprocating type electric shaver in accordance with the above-described embodiment.

In a reciprocating type electric shaver of this embodiment, as shown in FIG. 2, a triple blade head 10 is arranged at the top of a casing 9, and inner blades 3, 13 received within these three blade heads 10 are driven by a linear motor 14.

Figure 1:
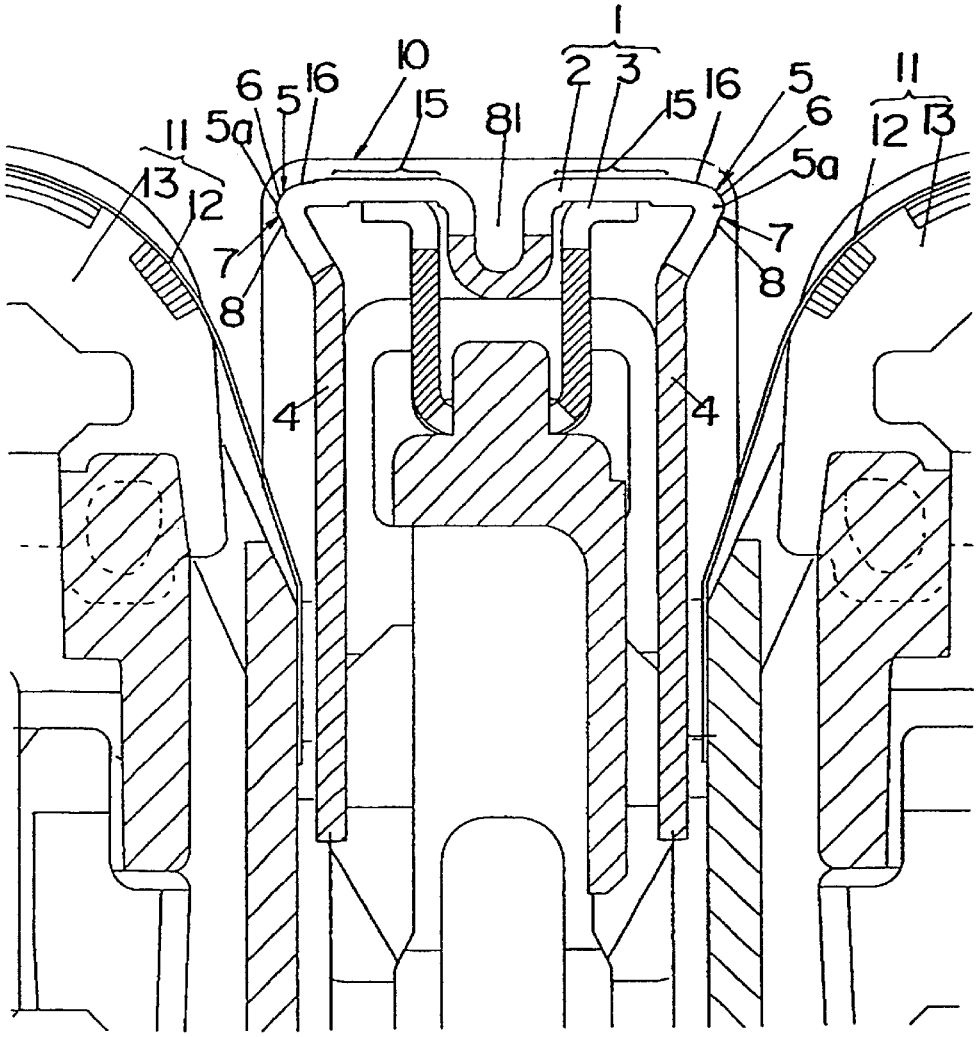
FIG. 1 is a cross-sectional view showing an embodiment in accordance with the present invention.

The blade head 10 will now be described with reference to FIGS. 1 to 8. As shown in FIG. 1, the blade heads 10 include a single slit blade 1 for roughly shaving, and a pair of web blades 11 disposed outside the slit blade 1. The slit blade 1 comprises a slit outer blade 2 and a comb-like slit inner blade 3 slidable abutting to the interior of the slit outer blade 2 and reciprocating. The web blades 11 each comprises foil-like outer blade 12 having a plurality of perforations for guiding the beard, being held in a curved shape, a inner blade 13 slidable abutting the interior of the outer blade 12 and reciprocating. The slit blade 1 and the web blades 2 can be floated in the vertical direction orthogonal to the reciprocating direction of the slit inner blade 3 and web inner blade 13. The linear motor 14 reciprocatinly drives the inner blades 3, 13 corresponding to the outer blades 2, 12 in the slit blade 1 and each web blade 11, respectively.

Figure 4:
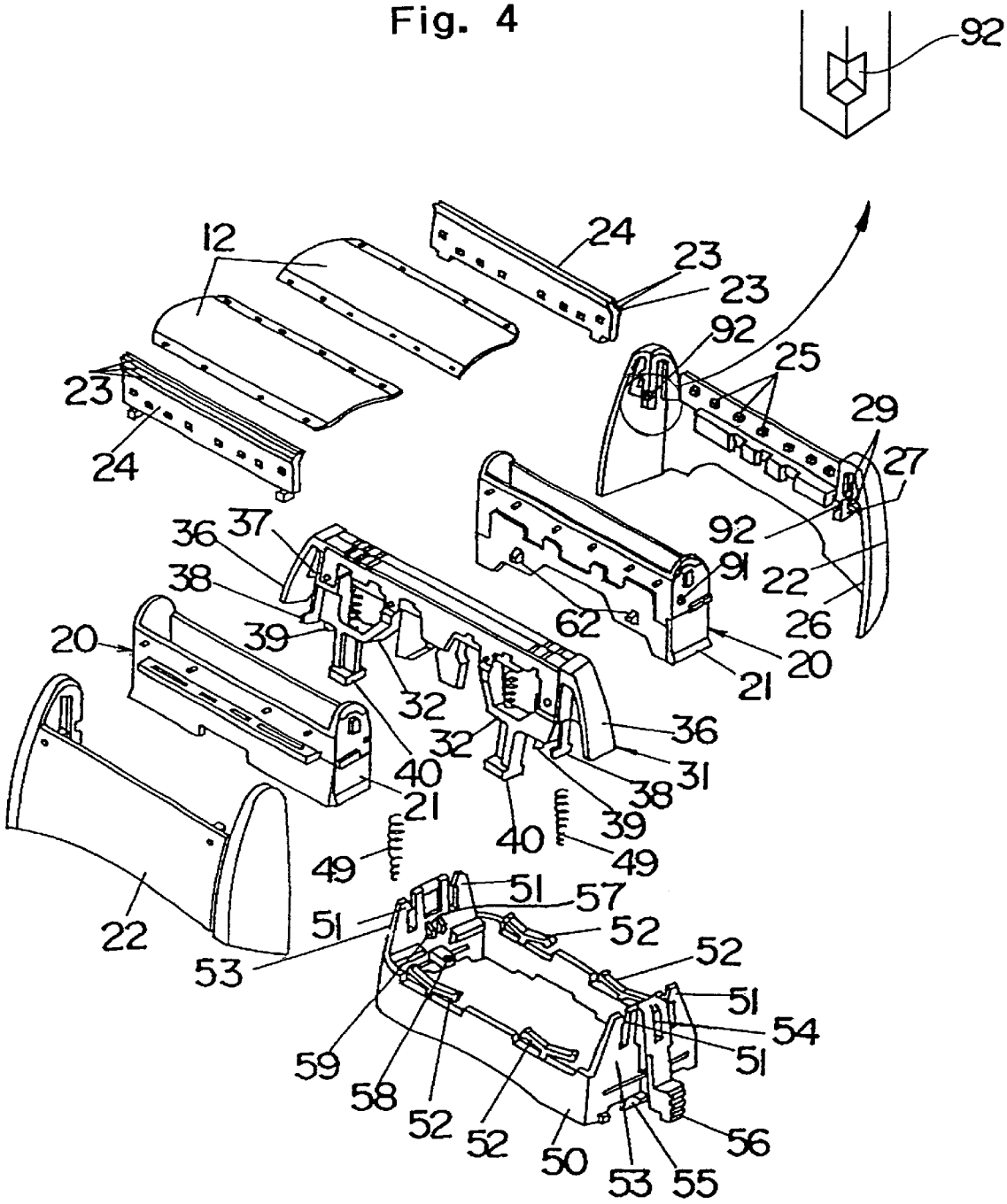
FIG. 4 is an exploded perspective view showing the blade head in accordance with the above-described embodiment.

FIG. 4 shows a construction of the blade head 10. A foil-like outer blades 12 are mounted to an outer blade frame 21 so as to be held in a curved shape, and the outer blade frame 21 is mounted from below to a floating supporting frame 22, and an engagement piece 91 is engaged with an engagement hole 92. Then, a web blade cassette 20 is assembled. A skin expanding member 24 having a plurality of thin elastic ribs 23 for expanding the skin to raise the beard is arranged between the floating supporting frame 22 and the outer blade frame 21.

Figure 7:
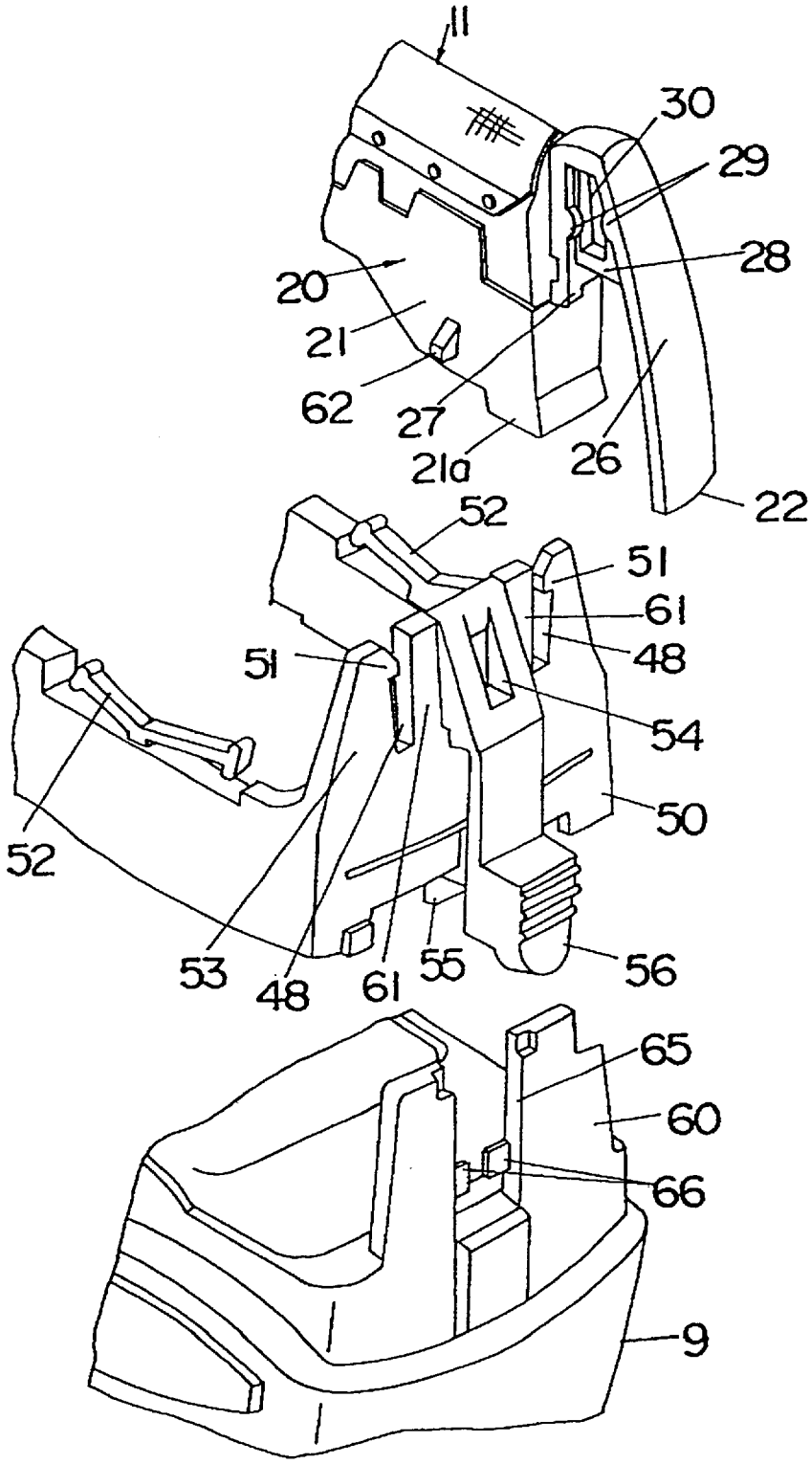
FIG. 7 is an exploded perspective view explaining the slit blade cassette, the holder member, and a body frame in accordance with the above-described embodiment.

The skin expanding member 24 is assembled by fitting into projections 25 formed on the inner surface of the floating supporting frame 22. The floating supporting frame 22 is formed with outer and inner walls 26, 27 at the ends thereof, which are successive to each other via engagement pieces 28, as illustrated in FIG. 7. Projections 29 are formed on the opposing faces of each outer and inner wall 26, 27, respectively. Above each engagement piece 28 is provided with an elongated hole 30 with which a hook 51 of a holder member 50 is engaged as described later.

Figure 5:
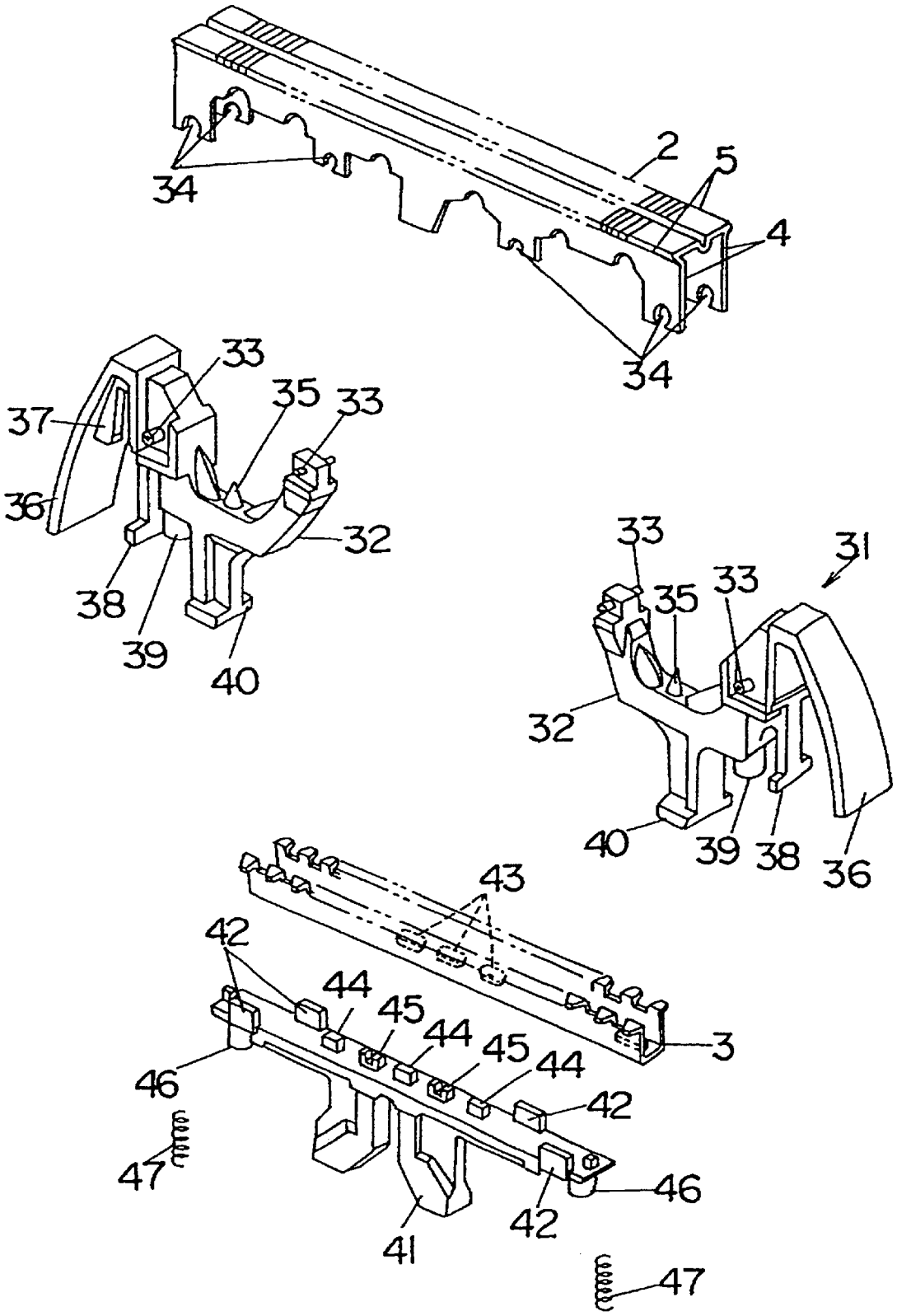
FIG. 5 is an exploded perspective view showing a slit blade cassette in accordance with the above-described embodiment.
Figure 6:
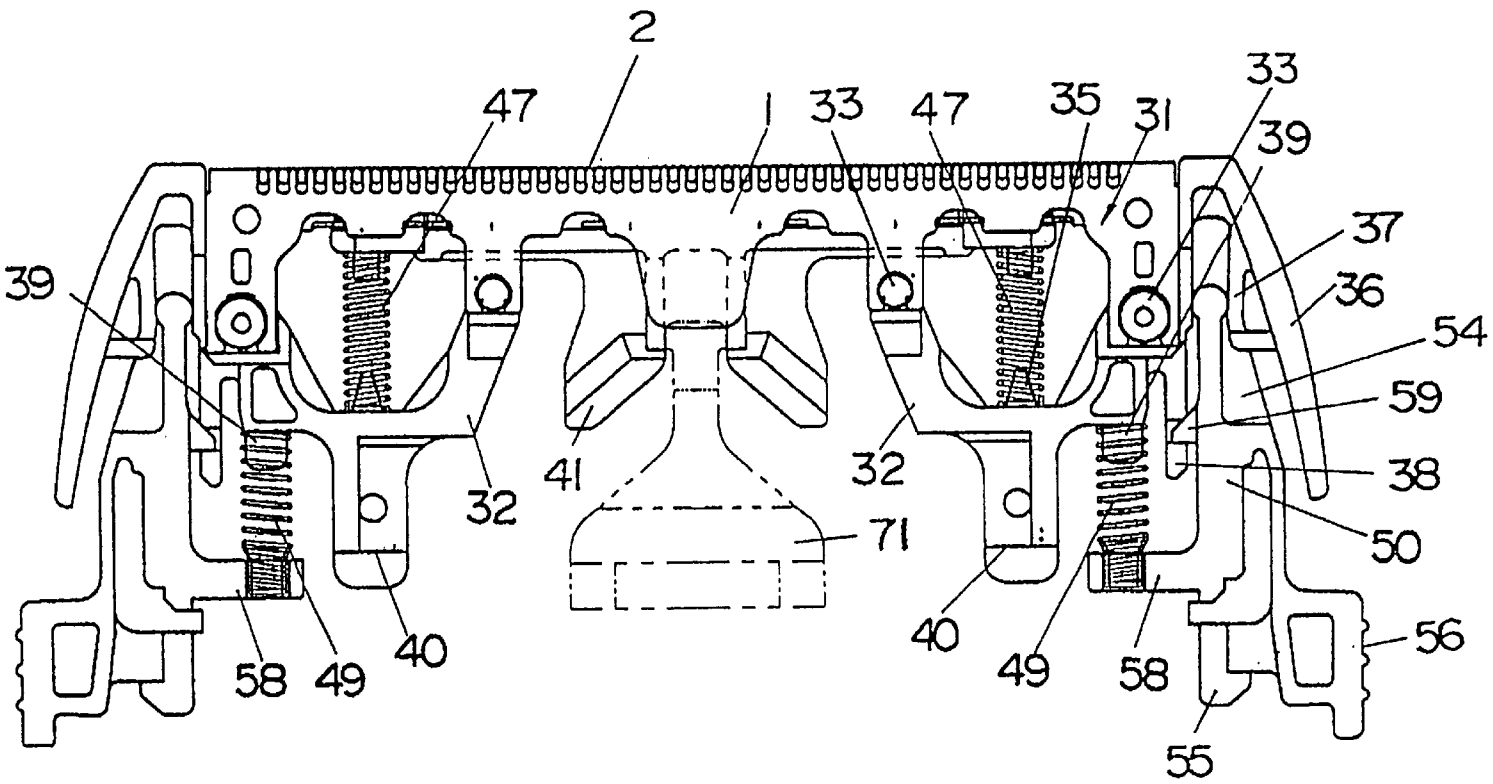
FIG. 6 is a front view in the state where the slit blade cassette of FIG. 5 and a holder member are assembled in accordance with the above-described embodiment.

FIG. 5 shows a construction of a slit blade cassette 31. Supporting bodies 32 are arranged at the ends in a longitudinal direction of the slit outer blade 2. While heat sealing bosses 33 formed in each supporting body 32 engage engagement portions 34 of the slit outer blade 2, each supporting body 32 is affixed to the slit outer blade 2 by heat sealing. Each supporting body 32 is provided with a spring bearing 35 at the inner surface side, and a cover piece 36 at the outer surface side which is formed with a longitudinal rib 37 on the inner surface. Each supporting body 32 includes at the lower end an retaining portion 38, a spring stopper 39, and a projection receiving face 40, which project downward. The slit inner blade 3 is pinched at the both sides by projecting walls 42 of each slit joint 41. Then, under such a condition, mounting holes 43 formed in a groove at the centre of the slit inner blade 3 is engaged with projections 44 and heat sealing bosses 45 formed on the upper surface of the slit joint 41. The heat sealing bosses 45 are then heat sealed to fit the slit inner blade 3 to the slit joint 41 in a heat sealing fashion. Spring receiving portions 46 are provided to the slit joint 41 at the lower end thereof. The spring receiving portions 46 each is allowed to engage with the top of a raised spring 47, while the bottom of the raised spring 47 is engaged with each spring bearing 35 of the supporting bodies 32 of the slit outer blade 2. As a result, the slit inner blade 3 slidable abut the inner surface of the slit outer blade 2, ensuring appropriate contact pressure on the sliding surfaces of the both blades, so that good shaving ability can be guaranteed.

The web blade cassette 20 and the slit blade cassette 31 are mounted to the casing 9 containing therein the linear motor 14 via a rectangular holder member 50 shown in FIG. 4 and a rectangular outer blade frame 60 shown in FIG. 7.

As shown in FIG. 4, the holder member 50 has a plurality of floating spring 52 integrally projected upward from the upper edge of the both edges. The holder member 50 is formed with end walls 53 in the elongated direction where elongated grooves 54 are formed in the outer surface above the centre widthwise. Button portions 56 having hooks 55 are provided below on the outer surface. Further, hook pieces 59 each having an elongated groove 57 are formed on an inner surface at the centre widthwise of the end walls 53, while spring receiving pieces 58 are attached at the lower portion of the hook pieces 59. When the retaining portions 38 of the supporting bodies 32 of the slit blade cassette 31 are engaged with the hook pieces 59 of the holder member 50, the slit blade cassette 31 is prevented from dropping against the holder member 50. In addition, floating springs 49 are disposed between the spring stoppers 39 of the supporting bodies 32 and the spring receiving pieces 58 of the holder member 50. This arrangement enables a spring force to be upward applied to the slit blade cassette 31 which can be floated up and down. At this time, each retaining portion 38 of the supporting bodies 32 is slidable within the elongated groove 57 on the inner surface of the holder member 50. Then, each longitudinal rib 37 formed in the inner surface of each cover piece 36 which is located outside the supporting bodies 32 is slidable within each elongated groove 54 formed in the outer surface of the holder member 50. Thus, the slit blade cassettes 31 are introduced in the vertical directions with respect to the holder member 50, vertically. For this reason, the slit blade cassette 31 is held at the centre portion widthwise of the holder member 50 to be freely vertically reciprocated.

As shown in FIG. 7, slit holes 48 opening upward are formed, respectively, in the end sides widthwise of the end walls 53 of the holder member 50. A hook 51 is projected from either upper side wall formed within each slit hole 48. The floating member frame 22 and the outer blade frame 21 are integrated with each other in the web blade cassette 20, and this integral component is deposited over each end side widthwise of the holder member 50. Engagement pieces 28 provided to the floating supporting frame 22 are engaged with the slit holes 48 of the holder member 50. Then, the hook 51 of the holder member 50 is fitted into the elongated hole 30 located above each engagement piece 28. Each projection portion 29 of the floating supporting frame 22 is brought into contact with the inner and outer surfaces of a introduce piece 61 about each slit hole 48 of the holder member 50. This prevents the floating supporting frame 22 from dropping by the hook 51 of the holder member 50. As a result, a pair of the web blade cassettes 20 can be held to br movable vertically between the ends widthwise of the holder member 50. At this time, a floating spring piece 52 of the holder member 50 comes into contact with a lower surface of a projection portion 21*a* of the outer blade frame 21. The upward spring force is then applied to the web blade cassette 20, capable of floating up and down. This up/down motion of the web blade cassette 20 is introduced by a slidable movement between the slit hole 48 of the holder member 50 and the engagement piece 28 of the floating supporting frame 22, and by the slidable movement between the projection portion 29 of the floating supporting frame 22 and the introduce piece 61 of the holder member 50.

In this connection, the slit blade 1 and the web blades 11 are independently floated up and down within the holder member 50. The lower surface of a projection 62 formed on either side surface of the outer blade frame 21 (see FIG. 4) is connected to projection receiving faces 40 (see FIG. 5) attached to the supporting bodies 32 of the slit blade cassette 31. In such assembling, when the web blades 11 are floated, the web blades 11 and the slit blade 1 are integrally down after the web blades 11 move down to a predetermined position.

The hook 55 inside the button portion 56 shown in FIG.7 is attachably/detachably engaged with a projection portion 66 on the inner surface of a groove 65 in each end of the longitudinal direction of the outer blade frame 60. With this arrangement, the holder member 50 can be mounted to the outer blade frame 60, while the button portion 56 is placed at the outer surface side of each end of the outer blade frame 60.

Figure 8:
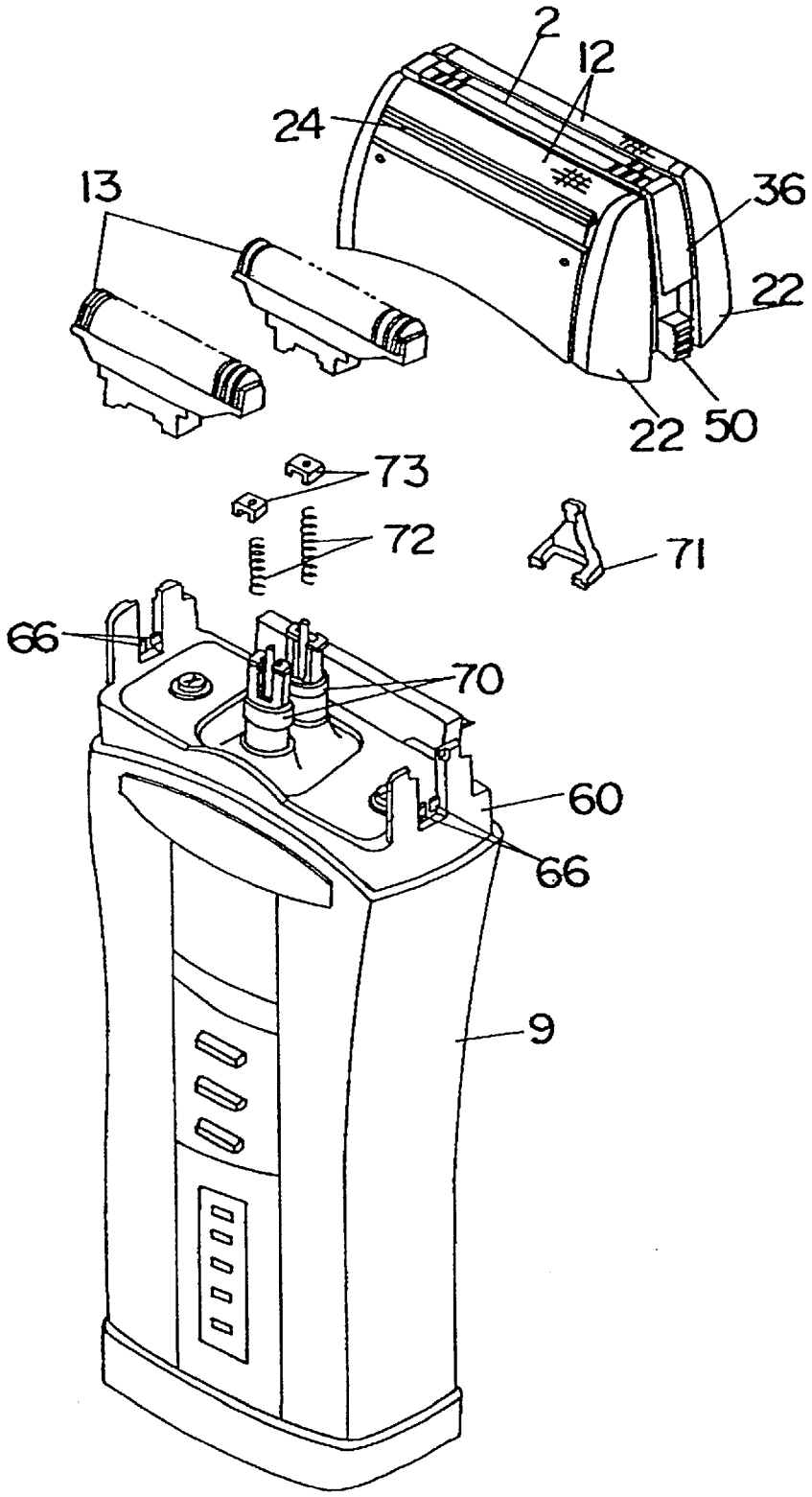
FIG. 8 is an exploded perspective view explaining the state where the blade head is mounted to the casing in accordance with the above-described embodiment.

As shown in FIG. 8, the inner blade 13 within the web blade cassette 20 is mounted onto the upper surface of a pair of driver-elements 70 projecting from the upper surface of the casing 9, with the upward spring force applied to the inner blade 13, by an inner blade raised spring 72. When the web blade cassette 20 is mounted to the casing 9 through the holder member 50 and the outer blade frame 60, the inner blade 13 contacts the inner surface of the outer blade 12. At this time, the reciprocating oscillation of the linear motor 14 contained in the casing 9 is transmitted to the inner blade 13 via the driver-elements 70. The motion of the linear motor 14 is also transmitted to the slit inner blade contained in the slit blade cassette 13 by connecting slit driver-elements 71 attached to the driver-elements 70 to the slit joints 41 (see FIG. 5). Reference numeral 73 of FIG. 8 denotes a stopper for preventing the inner blade raised springs 72 from dropping.

Now, description will be given in detail to the slit outer blade 2.

Figure 3:
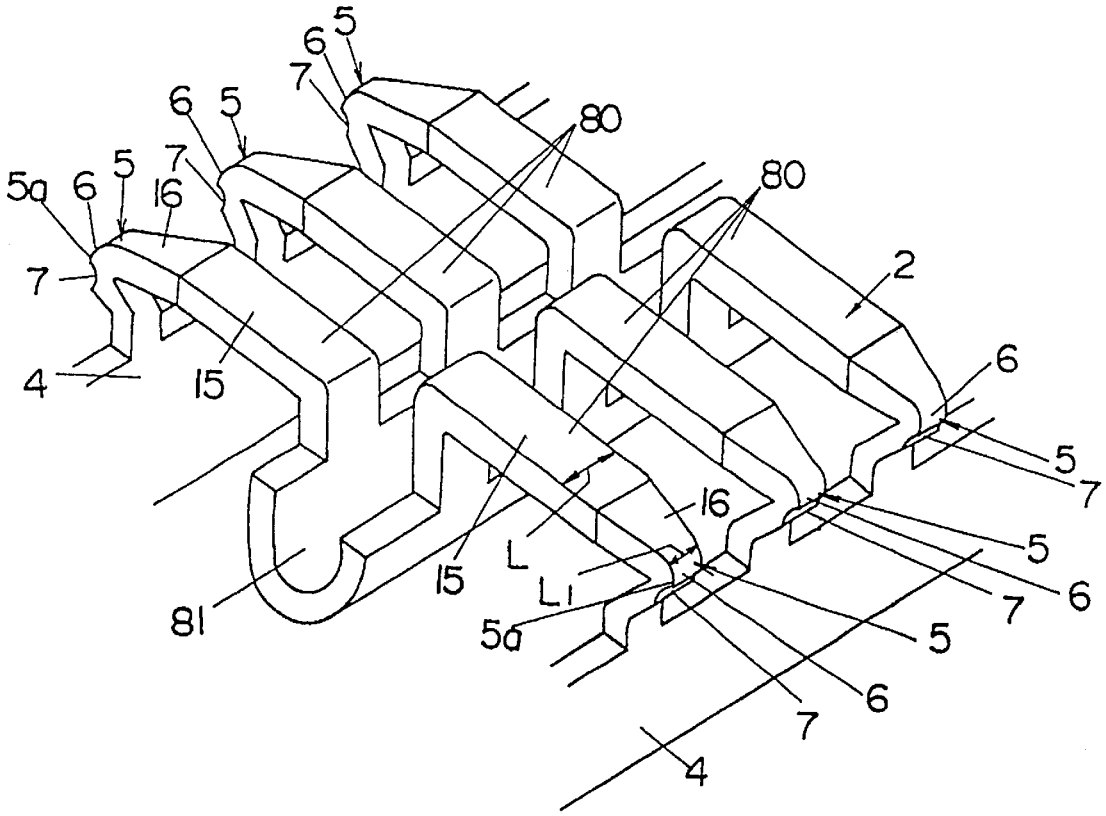
FIG. 3 is a perspective view explaining a slit outer blade in accordance with the above-described embodiment.

Referring now to FIG. 3, the slit outer blade 2 is made up by bending a single plate, and is formed with a plurality of bars 80 spanning the side walls 4, 4. Each of the bars 80 is jointly aligned a recess portion 81 formed at the centre on the upper surface of the slit outer blade 2. Each bar 80 is formed with a flat portion 15 which is substantially parallel to an axis Y where the peaks of the web blades 11 are aligned in a line. The slit inner blade 3 (see FIG. 1) is slidable inside the flat portion 15. Each bar 80 is formed with blade edges 5 at the both side edges which are located lower than the flat portion 15 and extend outward in a substantially triangular manner from the side walls 4. Each of the blade edges 5 is made up by machining each bar 80 to be bent at 120°. Each blade edge 5 machined to be bent at 120° is formed with a tapered face 16 on the upper surface. The tapered face 16 is successive to the flat portion 15, and is slant lower than the flat portion 15 as approaching a projecting peak 5*a* of the blade edge 5. The tapered face 16 is located inner by about 0.5 mm than the projecting peak 5*a* to the blade edge 5, having a slant angle set to about 12°. Of course, this angle is not to be limited to 12°. This tapered face 16 has a double functions to contact under a stable condition the skin between a pair of the web blades 11 to the flat portion 15 of the slit outer blade 2, and to closely contact with the skin so as to avoid the blade edge 5 from contacting with the skin to surely introduce the beard through the blade edge 5 thereby improving the ability of guiding the beard without an uncomfortable contact with the skin. In short, the blade edge 5 is designed to introduce the beard while the beard is cut on the flat portion 15 inside which the slit inner blade 3 is slidable.

Further, in an embodiment shown in FIG. 3, the width dimension L of each bar 80 is reduced in a tapering manner toward the outer end of the blade edge 5. The width dimension L of each bar 80 is reduced from the position by, for example, about 0.5 mm inner than the projecting peak 5*a* toward the blade edge 5, so as to bring the width dimension L1 at the tip of the tapered face 16 into about two third of the original width dimension L. With this arrangement, the opening degree at the blade edge 5, that is, a width dimension between the bars 80 can be made larger than a width dimension of each bar 80, so that the guidance of beard can be facilitated.

Figure 10:
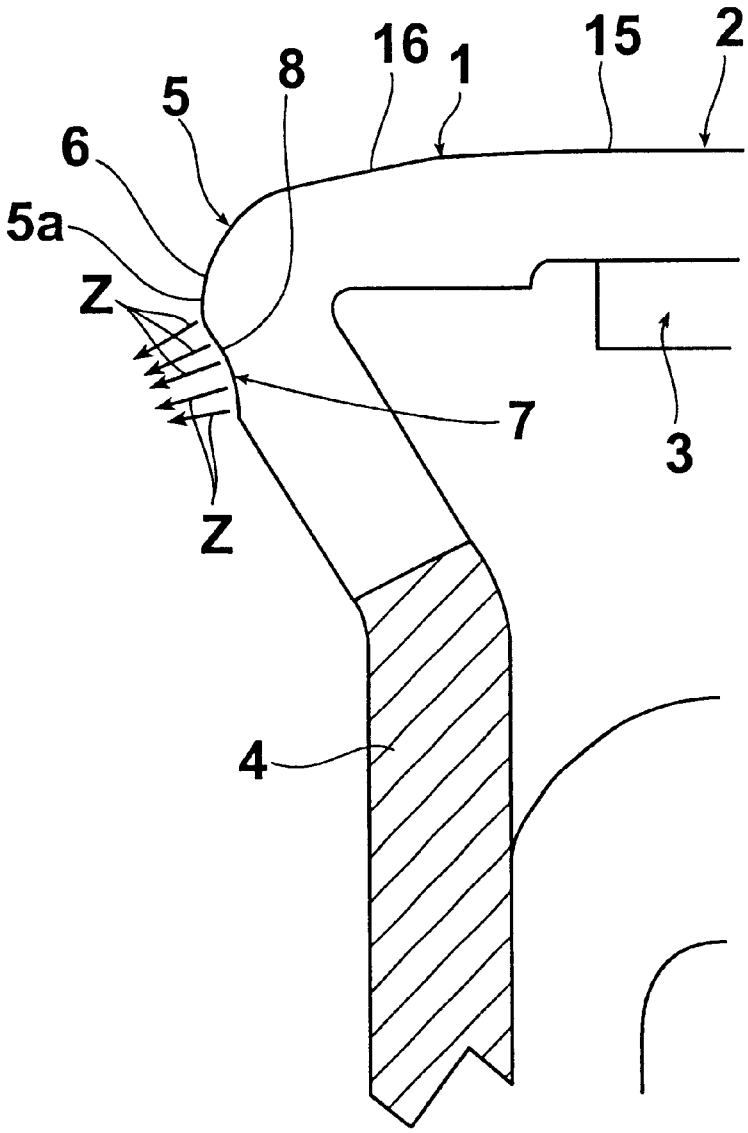
FIG. 10 is a cross-sectional view explaining a recess portion formed at the blade edge of the slit outer blade in accordance with the above-described embodiment.

As shown in FIG. 10, the blade edge 5 is formed with a convexity 6 gently curving toward the outer end. The blade edge 5 is also formed with a recess portion 7 for raising the beard. The recess portion 7 is recessed substantially opposite to the projecting direction of the blade edge 5, which lies lower than the projecting peak 5*a* of the blade edge 5. The recess portion 7 is a thin portion 8 reduced in thickness of each bar 80. The recess portion 7 has an upper end arranged in the vicinity of the projecting peak 5*a* of the blade edge 5 and an lower end arranged below the projecting peak 5*a*. In this connection, the recess portion 7 is downwardly faced at any place with the normal Z at least downward to a horizontal line.

Figure 9:
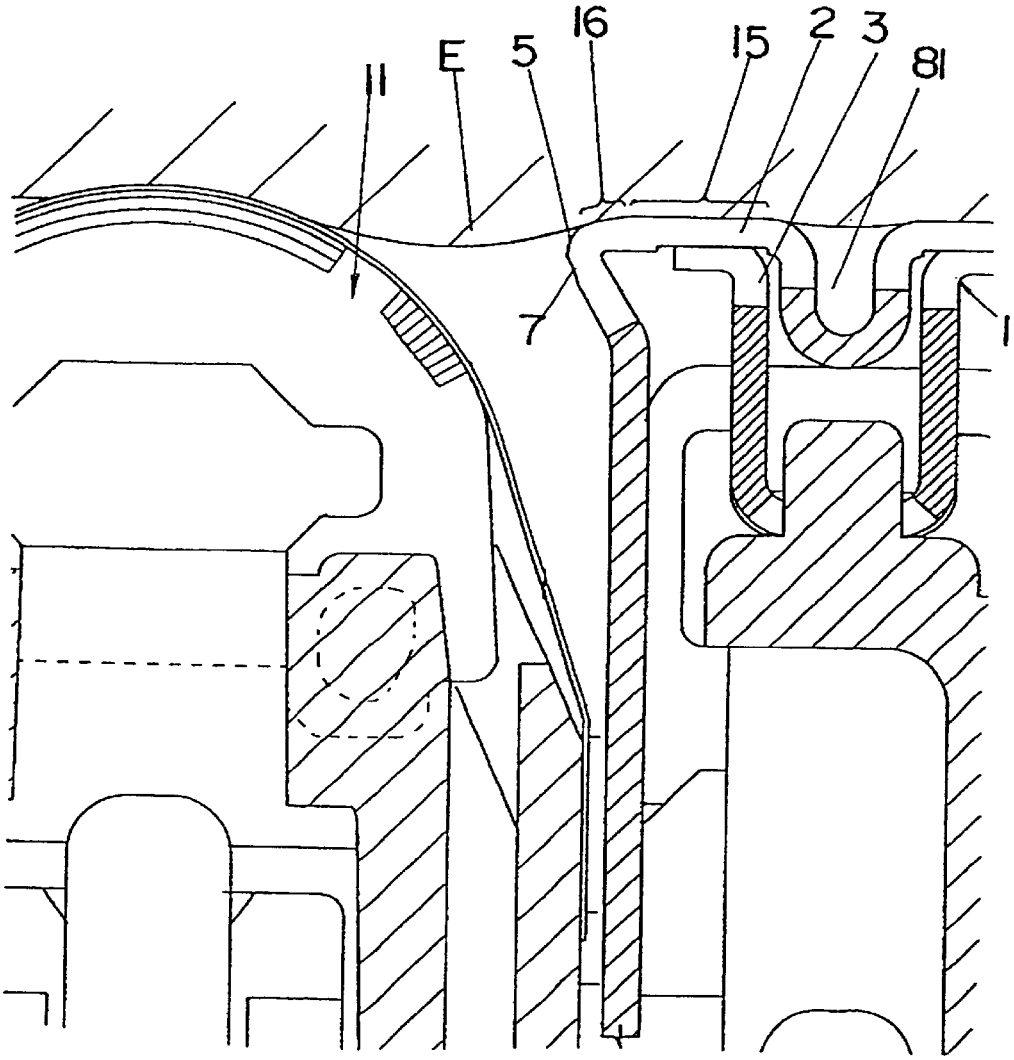
FIG. 9 is a cross-sectional view showing the state where the slit blade is brought into contact with the skin in accordance with the above-described embodiment

The slit blade 1 is arranged between a pair of the web blades 11, rendering the upper surface of the slit outer blade 2 the flat portion 15 substantially parallel to an axis where the peaks of the web blades 11 are aligned in a line. This arrangement allows the skin to contact with the upper surface of the slit outer blade 2 under a stable condition, causing the guiding function at the blade edge 5 to be more effectively performed. In this connection, the blade edge 5 is formed with a tapered face 16 at the upper surface. Therefore, as shown in FIG. 9, by the tapered surface 16, the skin E between a pair of the web blades 11 can be brought into contact with the flat portion 15 of the slit outer blade 2 under a stable condition. In addition, the tapered face 16 prevents the blade edge 5 from contacting with the skin and allows the skin E to closely contact therewith so that it ensures that the beard can be introduced at the blade edge 5. Therefore, the ability of guiding the beard can be improved without an uncomfortable contact with the skin.

Incidentally, without the tapered face 16 formed on the upper surface of the blade edge 5, the projection of the blade edge 5 will stimulate to the skin, causing an uncomfortable contact with the skin. However, formation of the tapered face 16 will prevent the blade edge 5 from impinging on the skin E to obtain a comfortable contact with the skin.

In addition, the blade edge 5 is designed to introduce the beard. Since the slit inner blade 3 is slidable only inside the flat portion 15 but are not slidable inside the tapered face 16 nor the blade edge 5, the beard is cut at the flat portion 15. Accordingly, even if the tapered face 16 is come into contact with the skin, the slit inner blade 3 cannot impinge on the skin. Therefore, a comfortable contact with the skin can be obtained, achieving an improvement of the shaving ability.

Further, as shown in FIG. 3, the width dimension L of each bar 80 is reduced in a tapering manner toward the blade edge 5. This enables the degree of the opening formed between the blade edges 5, 5 to more improve the guiding ability. Incidentally, with the width of each bar of the blade edge 5 reduced, an uncomfortable contact with the skin will be anticipated because the bars 80 are sunk into the skin. However, the tapered face 16 is provided on the upper surface of the blade edge 5, so as to prevent the blade edge 5 from impinging on the skin. Therefore, the bars 80 having the reduced width will not be sunk into the skin, realizing a high degree of the opening formed between the blade edges 5, 5 without an uncomfortable contact with the skin. Further, the recess portion 81 is formed at the centre on the upper surface of the bars 80, and this enables the lying beard to be raised within the recess portion 81. Thus, opportunity of guiding the beard can be doubled with such a compact arrangement.

Further, according to the present embodiment, the recess portion 7 that is downwardly faced at any place is formed in the vicinity of the projecting peak 5*a* of the blade edge 5. Then, the beard that impinges upon each blade edges 5 is captured in by the recess portion 7 to be raised and be surely introduced to the slit blade. This enables the beard captured into the recess portion 7 to be surely trimmed and introduced. As a result, with a comfortable contact with the skin, the ability of guiding the beard can be remarkably improved to shave the beard more effectively.

Figure 11A:
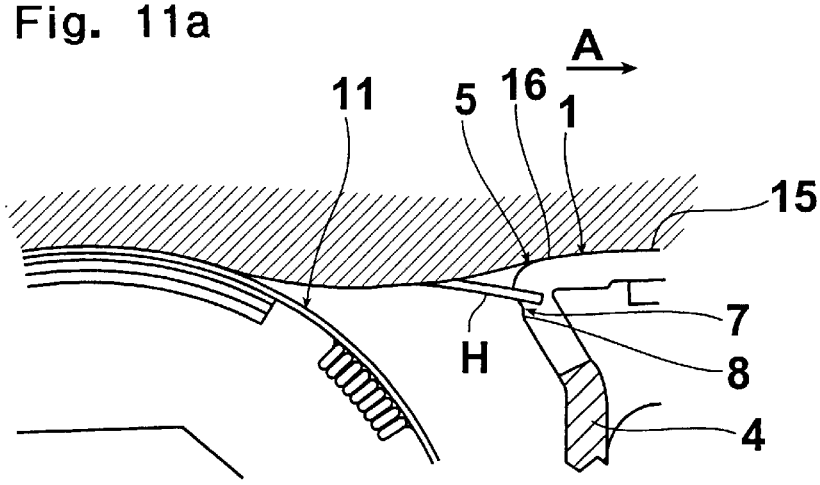
FIGS. 11A to 11C are cross-sectional views each explaining the shaving mechanism with the recess portion in accordance with the above-described embodiment.
Figure 11B:
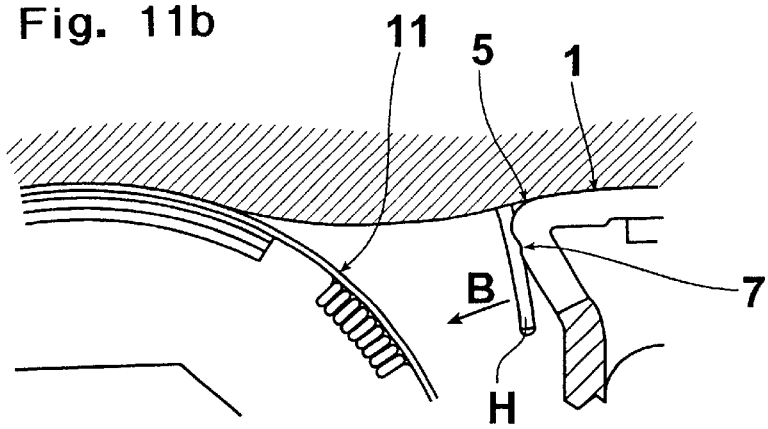
Figure 11C:
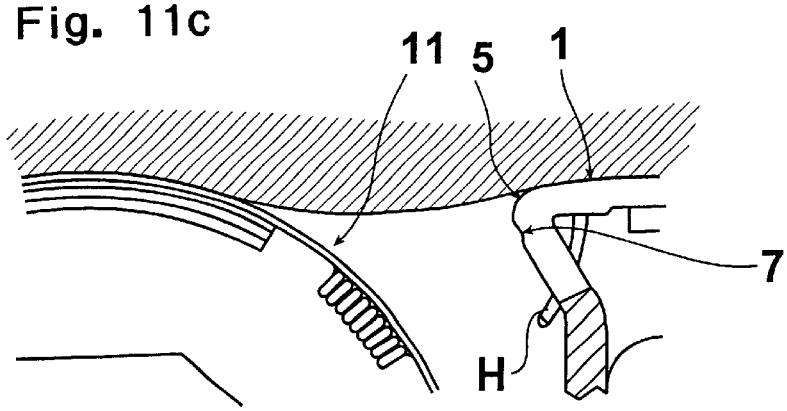

Referring now to FIGS. 11A to 11C, illustrated is a trimming mechanism by the recess portion 7. In FIG. 11A, an arrow A indicates an advancing direction of the skin E. As shown in FIG. 11A, the lying beard H first impinges upon the blade edge 5 to be captured into the recess portion 7. As indicated by an arrow B of FIG. 11B, the beard H is raised stepwise as the blade edge 5 approaches the root of the beard H. At this time, as indicated by the normal Z of FIG. 10, the recess portion 7 is downwardly faced at any place, or there is no face upward. Then, as shown in FIG. 11C, the captured beard H by the recess portion 7 is surely raised, and the lying beard H can be trimmed and be introduced. This ability can be also effective on the guidance of the laterally kinked beard which is difficult to be introduced in general. Furthermore, as shown in FIG. 1, the downwardly facing recess portion 7 is provided to the blade edge 5 formed on the upper surface at the ends of the slit outer blade 2. The beard can be positively trimmed and introduced whenever the beard is shaved from either direction of the slit outer blade 2. Also, the projecting peak 5*a* of the blade edge 5 becomes the convexity 6, and this can reduce the stimulation to the skin. As a result, with a comfortable contact with the skin improved, the ability of guiding the beard can be remarkably improved to shave the beard more effectively.

Figure 12:
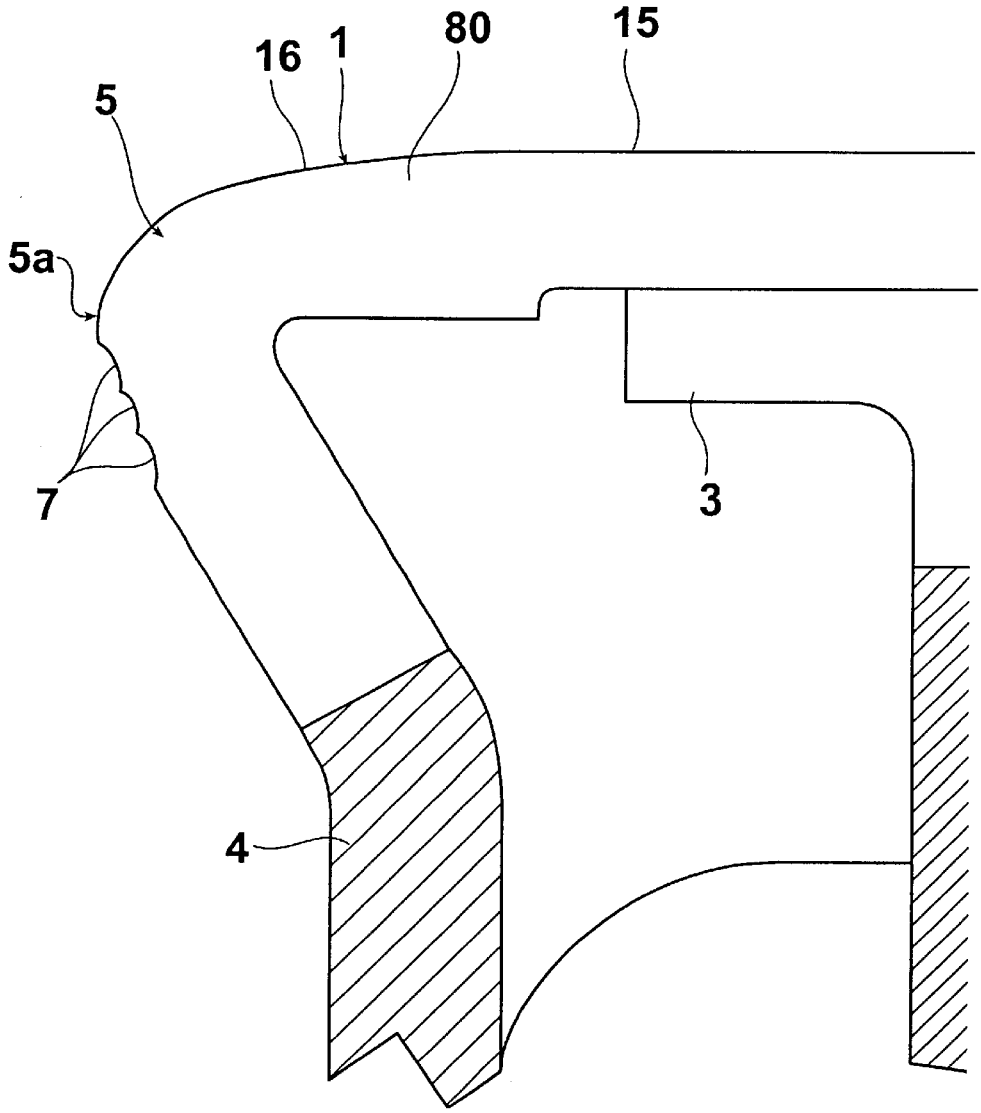
FIG. 12 is a cross-sectional view explaining a recess portion in accordance with another embodiment of the present invention.

FIG. 12 shows that the recess portion 7 is plural. According to this embodiment, three successive recess portions 7 are arranged at the lower level than the projecting peak 5*a* of the blade edge 5. With such an arrangement that the recess portion 7 is plural, a chance of shovelling the beard can be increased, more improving the guidance ability. Of course, the number of the recess portions 7 is not to be limited to three, but may be three or less, or three or more.

Figure 13:
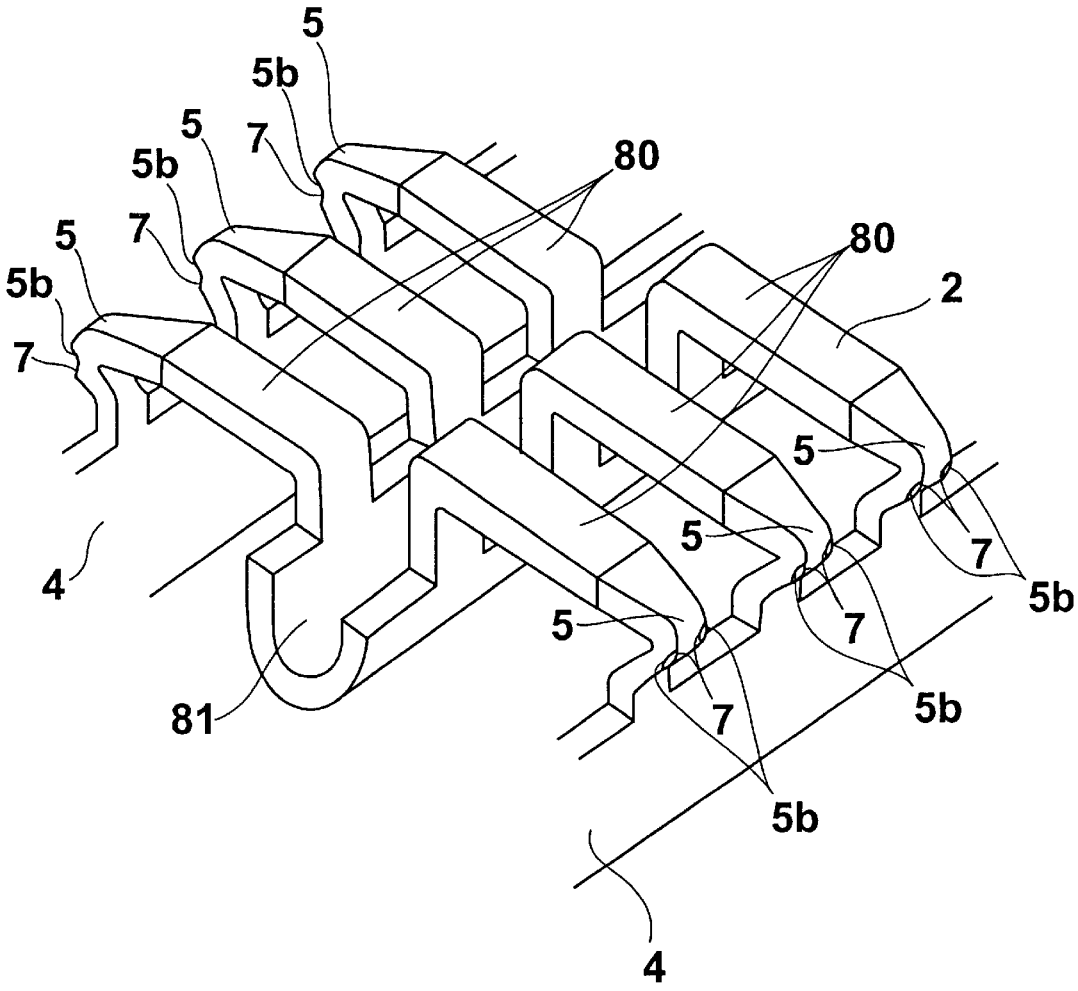
FIG. 13 is a perspective view explaining a recess portion in accordance with still another embodiment of the present invention.

FIG. 13 shows that the recess portion 7 is arranged only at the side edges 5*b* of the bar 80 of the blade edge 5. According to this embodiment, the recess portion 7 is formed at each side edge 5*b* of the bar 80 constituting the blade edge 5. Such an arrangement that the recess portion 7 is formed only at each side edge 5*b* enables the ability of guiding the beard to be improved as well as the strength of the bar 80 to be more guaranteed. Also, the recess portion 7 may be formed only at either side edge 5*b* of the bar 80.

Alternatively, the slit outer blade 2 may not be formed with a recess portion (see FIG. 1) at the centre on the upper surface thereof, while the entire upper surface of the slit blade may be rendered a flat portion 15. In this connection, the effects of trimming and guiding the beard can be attained at the ends of the blade edge 5, and the structure of the bar 80 and the structure of the slit inner blade 3 can be more simplified.

A description will now be given to floating cooperating portion between the slit blade and the web blades.

The outer blade frame 21 of the web blade 1 is formed with a projection 62, and the lower surface of the projection 62 is connected to a projection receiving face 40 provided to the supporting bodies 32 of the slit blade cassette 31, constituting a floating cooperating portion. The web blades 11 and the slit blade 1 are integrally down by cooperating with the down motion of the web blades 11 after the web blades 11 move down to a predetermined position. As shown in FIG. 5, the projection receiving face 40 is formed on the side faces of the supporting bodies 32 of the slit blade cassette 31. In the state where the slit blade 1 is floated solely, the slit blade 1 is floated solely. When the both or either of a pair of the web blades 11 is floated, the projection 62 is contacted to the projection receiving face 40 so that the slit blade 1 can be also cooperated therewith to be floated.

Figure 14:
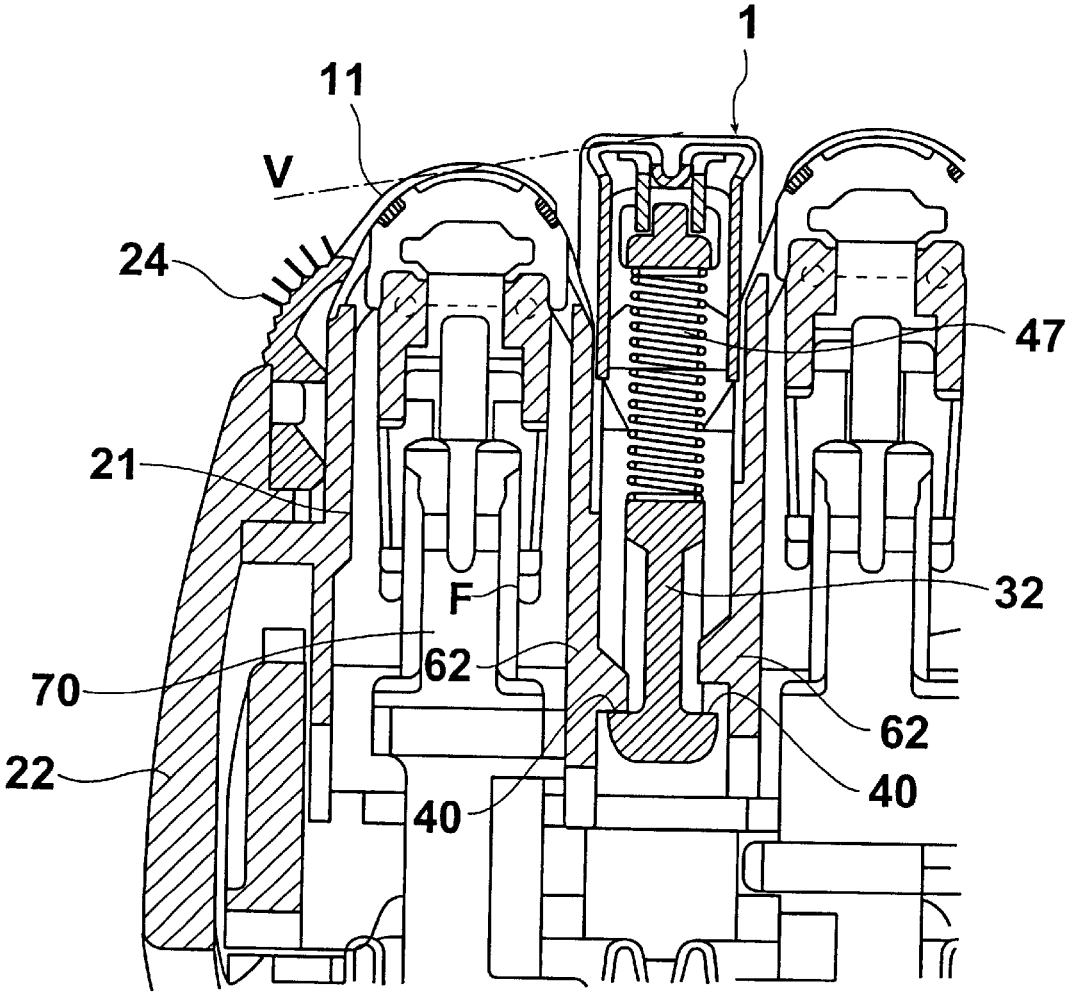
FIG. 14 is a cross-sectional view explaining the state where the slit blade and the web blades are cooperated with each other.
Figure 15:
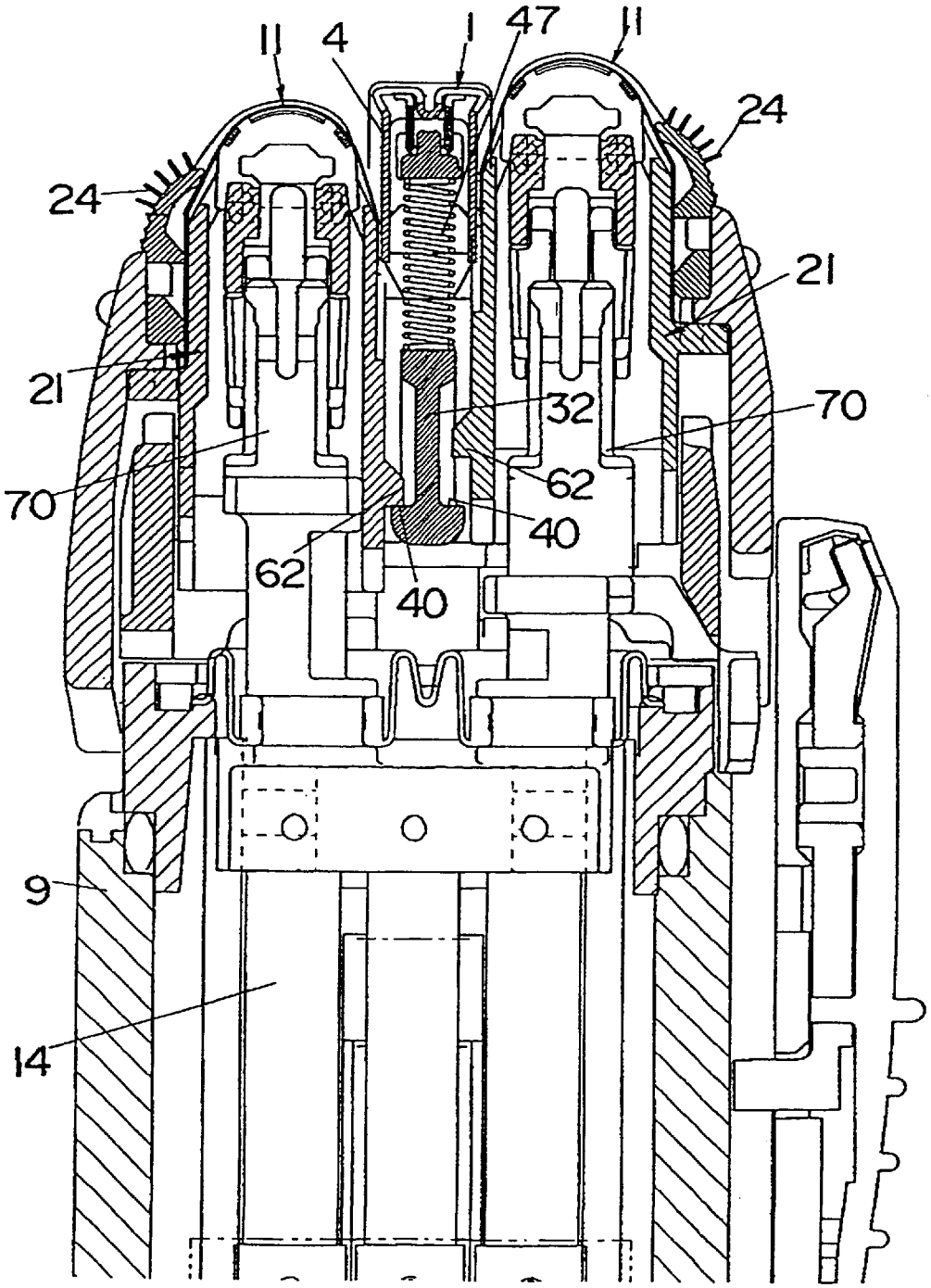
FIG. 15 is a cross-sectional view explaining the floating state of either web blade.

Incidentally, in the case where the web blades 11 and the slit blade 1 are all independently floated, as the web blades 11 are pushed in the direction of an arrow T of FIG. 2, the relative distance between the peaks of the web blades 11 and the top face of the slit blade 1 is made larger. Then, there will occur a risk in which the blade edge 5 of the slit blade 1 which may be exposed will stimulate the skin, or the skin will be pinched between the web blades 11 and blade edges 5 of the slit blade 1. In order to obviate such disadvantages, according to this embodiment, as shown in FIG. 14, the web blades 11 are independently floated until the web blades 11 reach in the vicinity of a tapered extension V extending the upper surface of the slit blade 1. In addition, at the lower level than this, the positional relation between the projection 62 and the projection receiving face 40 is set so that as shown in FIG. 15, as the web blades 11 are down, the slit blade 1 is also down integrally therewith. With this arrangement, the blade edge 5 of the slit blade 1 can effectively introduce the beard without giving uncomfortable feeling to the skin. Thus, more effective guiding ability can be ensured, improving the following ability to the skin, in particular, at the irregular sites such as a site extending from the throat to the chin, and a site extending from the chin to the tip of chin. Further, as shown in FIG. 14, as the web blades 11 are down, the slit blade 1 is down by cooperating therewith. Thus, when the web blades 11 are passed through the above-noted irregular sites, as the web blades 11 are down, the slit blade 1 is also down by cooperating therewith prior to the exposure of the blade edge 5 of the slit blade 1. Alternatively, in the state where convex shaped sites such as chin are brought into contact with the space formed between the pair of web blades 11, the slit blade 1 is caused to be floated independently. Therefore, the blade edge 5 of the slit blade 1 does not stimulate the skin, and the following ability to the skin can be improved.

The projections 62 of the outer blade frame 21 of the web blades 11 and the projection receiving faces 40 of the supporting bodies 32 of the slit blade 1 are provided to the ends in the longitudinal direction (the sliding direction of the blades) thereof, respectively. In this connection, it is in the both ends in the longitudinal direction thereof that the web blades 11 are connected to the slit blade 1. Therefore, the relative step difference between the web blades 11 and the slit blade 1 is made constant at any place in the longitudinal direction thereof, and the blade edges 5 of the slit blade 1 are not exposed, so that the following ability to the skin can be improved. With such an arrangement of the present invention, the foregoing advantages can be achieved.

Further, as shown in FIG. 15, a connection between the slit blade 1 and the web blades 11, or a connection between the projection 62 of the outer blade frame 21 of the web blades 11 and the projection receiving face 40 of the supporting bodies 32 of the slit blade cassette 31, is located inner than the side wall 4 of the slit outer blade 2. With this arrangement, the position where the retaining portion 38 attached to the supporting bodies 32 of the slit blade cassette 31 shown in FIG. 5 can be at substantially the same level in the direction of the thickness of the slit blade 1 as the position where the projection 62 is connected to the projection receiving face 40. For this reason, no twisting moment will occur, and therefore the friction or the like can be reduced between the longitudinal rib 37 of the supporting bodies 32 of the slit blade cassette 31 (see FIG. 5) and the longitudinal groove 54 of the holder member 50 (see FIG. 6). As the web blades 11 and the slit blade 1 are down, the slit blade 1 can be smoothly floated.

As described above, according to a first aspect of the present invention, the flat portion of the slit outer blade can be brought into contact with the skin under a stable condition so that a function of guiding the blade edge can effectively work. In addition, the tapered face allows the skin between a pair of the web blades to be contacted with the flat portion of the slit outer blade under a stable condition. Further, the tapered face prevents the blade edge from contacting with the skin and allows the skin to closely contact therewith so that it ensures that the beard can be introduced. Therefore, the ability of guiding the beard can be improved without an uncomfortable contact with the skin. Further, the slit inner blade is slidable only inside the flat portion. Accordingly, even if the tapered face is come into contact with the skin, the slit inner blade cannot impinge on the skin, with a comfortable contact with the skin, achieving an improvement of the shaving ability.

According to a second aspect of the present invention, in addition to the operational effect in the first aspect of the present invention, the width dimension of each bar formed between the slits is reduced toward the blade edge. With this arrangement, the blade edge having reduced width cannot be sunk into the skin by virtue of the tapered face formed on the upper surface thereof, realizing a high degree of the opening formed at the blade edge without an uncomfortable contact with the skin. This also allows the guiding ability to be improved.

According to a third aspect of the present invention, in addition to the operational effect in the first aspect of the present invention, the bar is formed with the recess portion at the centre on the upper surface thereof, and this enables the lying beard to be raised within the recess portion. Thus, opportunity of guiding the beard can be doubled with such a compact arrangement.

According to a fourth aspect of the present invention, in addition to the operational effect in the first aspect of the present invention, a cooperating portion is provided for moving the slit blade together with the downward motion of the web blades when the web blades are down. Such a cooperation of the web blades and the slit blade prevents the relative distance formed between the peaks of the web blades and the upper surface of the slit blade from being increased. With such an arrangement, the blade edge of the slit blade are not so exposed beyond the peaks of the web blades. This prevents the skin from being stimulated and the skin from being pinched between the web blades and the blade edge of the slit blade. As a result, the skin cannot be stimulated by the blade edge in the course of the shaving at irregular sites such as chin, improving the following ability to the skin, so that more stimulation to the skin can be reduced to ensure the guiding ability.

Further, according to a fifth aspect of the present invention, in addition to the operational effect in the fourth aspect of the present invention, the blade edge of the slit blade allows the beard to be effectively introduced without giving an uncomfortable feeling to the skin, more effectively ensuring the guiding ability.

Still further, according to a sixth aspect of the present invention, in addition to the operational effect in the fourth aspect of the present invention, a cooperating portion between the slit blade and the web blades are provided inner than the side walls of the slit outer blade. This arrangement enables, for example, the cooperating position of the web blades and the slit blade to be coplanar in the direction of the thickness of the slit blade. For this reason, no twisting moment will occur, enabling the slit blade to be more smoothly floated during the cooperation.

Still further, according to a seventh aspect of the present invention, in addition to the operational effect in the fourth aspect of the present invention, the cooperating portion of the slit blade and the web blades is provided at the ends in the direction of sliding the slit inner blade. Therefore, the relative step difference between the web blades and the slit blade is made constant at any place in the slidable direction thereof, and the blade edge of the slit blade are not exposed, so that the following ability to the skin can be improved.

Still further, according to an eighth aspect of the present invention, in addition to the operational effect in the first aspect of the present invention, the blade edge of the slit outer blade is projected outward in a substantially triangular manner from a side wall of the slit outer blade, the projecting peak of the blade edge projecting in a substantially triangular manner being formed on a convexity, a recess portion recessed substantially opposite to the projecting direction of the blade edge being formed in the vicinity of the blade edge, the recess portion being downward faced at any place within the recess portion with the normal downwardly faced to a horizontal line. This arrangement ensures that the beard captured in the recess portion can be trimmed and introduced. In addition, the projecting peak is formed with a convexity, reducing the stimulation to the skin. As a result, with a comfortable contact with the skin, the ability of guiding the beard can be remarkably improved to shave the beard more effectively.

Still further, according to a ninth aspect of the present invention, in addition to the operational effect in the eighth aspect of the present invention, the recess portion is plural. This arrangement can increase a chance of picking up the beard and improve the guiding ability.

Still further, according to a tenth aspect of the present invention, in addition to the operational effect in the eighth aspect of the present invention, the site where the recess portion is formed is located only at the side edges of the bar of the blade edge. This arrangement ensures the strength of the blade edge.

What is claimed is:

1. A reciprocating type electric shaver comprising blade heads including:

(a) a slit blade;

said slit blade comprising:

a slit outer blade having a plurality of slits for introducing beard onto at least the upper surface, said slit outer blade also having side walls; and a slit inner blade for cutting the beard introduced from the slits of said slit outer blade with said slit outer blade, said slit inner blade slidable connected to the inner surface of said slit outer blade and reciprocatingly moved; and (b) web blades;

said web blades having peak portions and comprising:

a web outer blade disposed at the outer sides of said slit blade orthogonal to the reciprocating direction of said slit inner blade, said web outer blade having a plurality of perforations for introducing the beard, being held in a curving shape; and a web inner blade for cutting the beard introduced from the perforations of said web outer blade with said web outer blade, said web inner blade slidable connected to the inner surface of said web outer blade and reciprocating;

wherein said slit blade and web blades are capable of being floated, respectively, in the vertical directions orthogonal to the reciprocating directions of said slit inner blade and said web inner blade, and wherein said slit outer blade further comprises: (i) a flat portion formed on the planar upper surface and substantially parallel to the axis where the peaks of the adjacent web blades are aligned in a line, said slit inner blade being slidable inside the flat portion, (ii) a blade edge formed on the upper surface and projecting outward at the web blade side beyond the side walls of said slit outer blade, said blade edge located at side edges along the reciprocating direction of said slit inner blade on the flat portion, and (iii) a tapered face located between the flat portion and the blade edge and successive to the flat portion so as to be slant in the direction lower than the flat portion as approaching the outside end of the blade edge.

2. A reciprocating type electric shaver as claimed in claim 1, wherein the width dimension of each bar formed between the slits of said slit outer blade is reduced as approaching the outer ends of the blade edge.

3. A reciprocating type electric shaver as claimed in claim 1, wherein a recess portion recessed at a lower level than flat portion is formed at the centre on the upper surface of said slit outer blade.

4. A reciprocating type electric shaver as claimed in claim 1, including a cooperating portion for cooperating the down motion of said web blades to move down said slit blade integrally therewith when said web blades are down.

5. A reciprocating type electric shaver as claimed in claim 4, wherein said web blades can be down independently of said slit blade while said web blades are down from the upper limit thereof to the position in the vicinity of the extension over the tapered face formed on the upper surface of said slit blade.

6. A reciprocating type electric shaver as claimed in claim 4, wherein said cooperating portion of said slit blade and said web blades are arranged at the position inner than the side walls of said slit outer blade.

7. A reciprocating type electric shaver as claimed in claim 4, wherein said cooperating portion of said slit blade and said web blades are arranged at the ends of said slit inner blade in the sliding direction.

8. A reciprocating type electric shaver as claimed in claim 1, wherein the blade edge of said slit outer blade is projected outward in a substantially triangular manner from each side wall of the slit outer blade, the projecting peak of the blade edge projecting in a substantially triangular manner being formed on a convexity, a recess portion recessed substantially opposite to the projecting direction of the blade edge being formed in the vicinity of the blade edge, the recess portion being downward faced at any place within the recess portion with the normal downwardly faced to the horizontal line.

9. A reciprocating type electric shaver as claimed in claim 8, wherein said recess portion is plural.

10. A reciprocating type electric shaver as claimed in claim 8, wherein said recess portion is arranged only on a side edge of a bar constituting the blade edge.

11. A reciprocating type electric shaver as claimed in claim 1, wherein said tapered face is flat.

* * * * *